US007604458B2

(12) United States Patent
Ishii et al.

(10) Patent No.: US 7,604,458 B2
(45) Date of Patent: Oct. 20, 2009

(54) AXIAL FLOW PUMP AND DIAGONAL FLOW PUMP

(75) Inventors: Takanori Ishii, Hitachi (JP); Ryuichiro Iwano, Hitachi (JP); Akira Manabe, Niihari-gun (JP); Yasuhiro Inoue, Niihari-gun (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 256 days.

(21) Appl. No.: 11/187,082

(22) Filed: Jul. 22, 2005

(65) Prior Publication Data

US 2006/0029495 A1 Feb. 9, 2006

(30) Foreign Application Priority Data

Aug. 4, 2004 (JP) ..... 2004-227867

(51) Int. Cl.
*F04D 29/42* (2006.01)
*F04D 29/54* (2006.01)

(52) U.S. Cl. ..... 415/208.2; 415/210.1; 415/211.2; 415/218.1

(58) Field of Classification Search ..... 415/191, 415/193–195, 199.4, 199.5, 208.2, 209.1, 415/209.4, 210.1, 211.2, 218.1, 219.1
See application file for complete search history.

(56) References Cited

U.S. PATENT DOCUMENTS

| | | | | |
|---|---|---|---|---|
| 3,075,743 | A * | 1/1963 | Sheets | 415/199.4 |
| 3,168,048 | A * | 2/1965 | Toyokura et al. | 415/221 |
| 4,981,414 | A * | 1/1991 | Sheets | 415/149.1 |
| 5,592,821 | A | 1/1997 | Alary et al. | |

FOREIGN PATENT DOCUMENTS

| | | | | |
|---|---|---|---|---|
| DK | 86999 | A * | 6/1959 | 415/208.2 |
| EP | 0 374 608 | | 12/1989 | |
| EP | 560372 | A1 * | 9/1993 | 415/208.2 |
| EP | 1 111 191 | | 6/2001 | |
| FR | 2681644 | | 3/1993 | |
| GB | 630747 | A * | 10/1949 | 415/194 |
| GB | 2 012 361 | | 1/1979 | |
| JP | 11-082390 | | 3/1999 | |

* cited by examiner

*Primary Examiner*—Christopher Verdier
(74) *Attorney, Agent, or Firm*—Hogan & Hartson LLP

(57) ABSTRACT

The guide vanes comprise two kinds of guide vanes which are alternately placed in the circumferential direction of a shroud. One kind of the guide vanes have a longer length than the other kind of the guide vanes, in the region which is close to the surface of the hub, but have substantially the same length as the other kind of the guide vanes, in the region which is close to the shroud. The leading edges of the second kind of guide vane are located further downstream in the pump axial direction than the leading edges of the first kind of guide vanes.

5 Claims, 8 Drawing Sheets

Cross sectonal view of guide vane cut by A1 cylinder

Cross sectonal view of guide vane cut by B1 cylinder

Cross sectonal view of guide vane cut by C1 cylinder

Cross sectonal view of guide vane cut by A2 cylinder

Cross sectonal view of guide vane cut by B2 cylinder

Cross sectonal view of guide vane cut by C2 cylinder

Small flow volume in conventional guide vanes

Large flow volume in conventional guide vanes

Small flow volume in guide vanes of the present invention

Large flow volume in guide vanes of the present invention

An application of the present invention to a diagonal flow pump

AXIAL FLOW PUMP AND DIAGONAL FLOW PUMP

FIELD OF INVENTION

The present invention relates to an axial flow pump and a diagonal flow pump, especially, those that have plural impeller blades and plural guide vanes placed downstream of the impeller blades.

Axial-flow pumps generate rotational energy in the fluid by means of the impeller blades thereof and convert the rotational energy to the static pressure by means of guide vanes placed downstream of the impeller blades. Usually, the impeller blades and the guide vanes have the respective same shapes and are mounted to the shaft and/or the casing at a uniform interval. The flow at the outlet of the impeller blades has a flow component along a rotational axis and an angular component which is called as a rotational component, hereinafter. The guide vanes are mounted in such a configuration that the leading edges of the vanes are corresponding to the angle of the downstream flow generated by the impeller blades. Since the flow condition of the fluid flow coming out from the impeller blades depends on the flow rate, the guide vanes are set to fit a certain single flow angle in a certain operating condition which is for a particular flow rate. The design where, for example, the angles $\alpha$ and $\gamma$ are the same in the configuration shown in FIG. 7 is aimed at maximizing the conversion from the rotational energy to the static pressure with such a particular flow volume.

The guide vanes are set such that the setting condition is optimized for a single particular operating condition. The reference shows guide vanes that have the same shape in the axial symmetry and provide an optimized performance for a certain condition.

Reference 1: Japanese laid open patent, H11-82390

SUMMARY OF THE INVENTION

One of the important performances required for the fluid pump is efficiency. Since pumps are operated under various conditions of the flow rate, high efficiency is required not only for a single specific condition but also for other different conditions of the flow rate. In the best performance of the guide vanes, the flow coming out from the impeller blades flows along the guide vanes and the rotational component of the flow is converted into static pressure at the stage of the flow passing by the guide vane. Since the cross sectional flow distributions such as those close to the hub of the vanes and those close to the shroud are different due to the difference of the rotational flow rate at the outlet of the impeller blades, the cross sectional shape of a blade in the region close to the hub is more declined than that of the blade in the region close to the shroud. Since the flow rate of the flow passing direction in the region close to the hub becomes small in a view of cross section when the flow rate becomes small, the angle $\alpha$ of the flow which comes into the guide vanes is smaller than the angle for the optimum flow rate operation and the flow direction at the leading edges of the guide vanes is deviated from the direction of the guide vanes. Accordingly, the flow is separated at the leading edges of the guide vanes and the vortexes caused by the separation are pushed out to the downstream from the leading edges of the guide vanes. Since these vortexes partially impede the flow paths generated between any adjacent two guide vanes located in the circumferential direction of the shroud and act as a resistance against the flow so that the total performance of the pump becomes worse. On the other hand, the component of of the flow rate with respect to the direction of the flow channel becomes large and the angle of the flow at the leading edges of the guide vanes is deviated when the operation is done in a larger flow rate than the optimum condition. The direction of the flow is deviated to the other side of the guide vanes opposite to the case where the flow rate is small and therefore the separation is generated on the opposite side of the leading edges of the guide vanes and that the vortexes of the separation partially impede the flow paths and reduce the pump performance. The distance between adjacent guide vanes in the cross sectional plane is shorter in the region close to the hub and longer in the region close to the shroud because the radius is smaller as the region is closer to the hub and therefore the effect of impeding flow paths due to the presence of the separation vortexes is particularly a serious problem in the region close to the hub.

The purpose of the present invention is to minimize the degradation of the performance due to the separation vortex generated at the leading edges of guide vanes by a change in the flow rate and to provide an axial flow pump and diagonal flow pumps that can maintain high performance in a wide range of operation condition from a small flow rate to a large flow rate.

Figure 1:
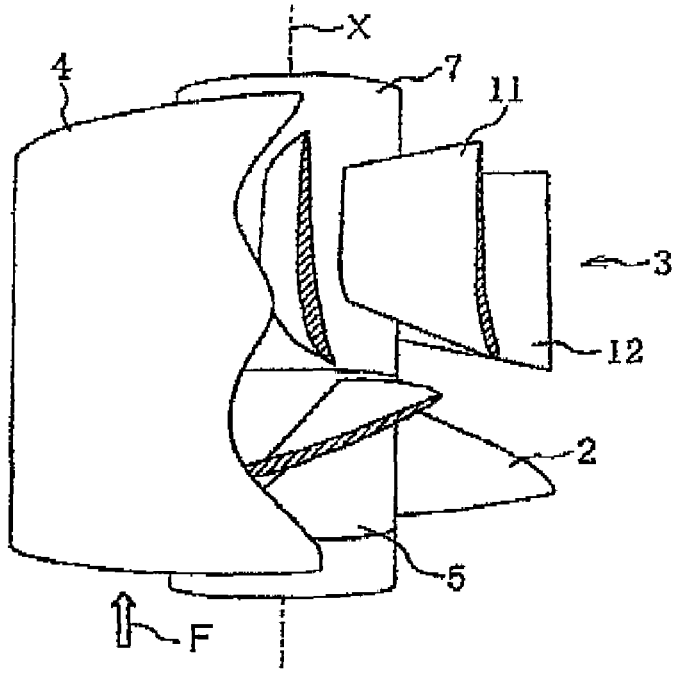
FIG. 1 is a schematic view that shows a structure of impeller blades and guide vanes of an axial flow pump of an embodiment in accordance with the present invention.

DETAILED DESCRIPTION OF THE INVENTION (1) In order to achieve the above purpose, the present invention provides an axial flow pump wherein a plurality of guide vanes is located in the circumferential direction of a shroud and downstream of a plurality of impeller blades, wherein the plurality of guide vanes includes plural kinds so that the leading edges of some of the guide vanes are placed downstream regarding the pump rotation axis direction of those of the other guide vanes.

Guide vanes are set downstream of the plurality of the impeller blades and the area of the inlet to a flow path to each of some guide vanes becomes large. Since the effective area of the inlet to the flow path to each guide vanes becomes large to overcome a problem due to the operation conditions other than the optimum condition, the performance degradation due to the separation vortexes generated at the leading edges of the guide vanes can be minimized and a high performance pump covering a wide range of operation condition from a small flow rate to a large flow rate is realized.

(2) In order to achieve the above purpose, the present invention provides an axial flow pump that has a plurality of impeller blades and a plurality of guide vanes set downstream of the plurality of the impeller blades wherein the pump has plural kinds of guide vanes provided regularly in the circumferential direction of a shroud and downstream of the impeller blades such that some of the guide vanes have the leading edges located further downstream than the leading edges of the other guide vanes.

According to this configuration, as explained in (1), the performance degradation due to the separation vortexes generated at the leading edges of the guide vanes can be minimized and a high performance pump covering a wide range of operation condition from a small flow rate to a large flow rate is achieved since the areas of the inlet of the flow paths to guide vanes becomes large.

(3) Another variation of the invention is that the plural kinds of the guide vanes are provided as the first plurality of guide vanes and the second guide vanes which have shorter vane length in the flow direction in comparison to the first guide vanes and the leading edges of the second guide vanes are located further downstream in comparison to the leading edges of the first guide vanes, preferably in addition to the variations described by (1) and (2).

(4) Another variation of the invention is that the plurality of the second guide vanes have a shorter vane length in the region close to the pump rotational axis than in the region far from the pump rotation axis and the vane length in the region close to the pump rotational axis is shorter than the first guide vanes in the direction of the pump rotation axis, preferably in addition to the variations described by (3).

(5) Another variation of the invention is that the plurality of the second guide vanes have a shorter vane length in the pump axial direction as closer to the pump rotation axis and the vane length in the region close to the pump rotational axis is shorter than the first guide vanes in the direction of the pump rotation axis, preferably in addition to the variations described by (3).

(6) In order to achieve the above purpose, the present invention provides a diagonal flow pump wherein a plurality of guide vanes is set downstream of the plurality of impeller blades and the leading edges of some of the guide vanes are placed downstream of the leading edges of the other guide vanes with respect to the pump rotation axis direction such that the guide vanes are regularly located in the circumferential direction of a shroud.

Accordingly, as explained in (1), since the effective area of the inlet to a flow path to each guide vane becomes large in to overcome a problem due to the operation conditions other than the optimum condition, the performance degradation due to the separation vortexes generated at the leading edges of the guide vanes can be minimized and the high performance pump covering a wide range of operating condition from a small flow rate to a large flow rate can be provided.

(7) In order to achieve the above purpose, the present invention provides a diagonal flow pump that has a plurality of impeller blades and a plurality of guide vanes being set downstream of the plurality of impeller blades wherein the pump has plural kinds of guide vanes provided regularly in the circumferential direction of a shroud and downstream of the impeller blades such that some of the guide vanes have the leading edges placed further downstream than the leading edges of the other guide vanes.

According to this configuration, as explained in (1), the performance degradation due to the separation vortexes generated at the leading edges of the guide vanes can be minimized and a high performance pump covering a wide range of operation condition from a small flow rate to a large flow rate can be obtained since the area of the inlet of the flow to flow paths to guide vanes becomes large.

According to the present invention, it is possible to minimize the degradation of the performance due to the separation vortex generated at the leading edges of guide vanes caused by variation in the flow rate and to realize an axial flow pumps and diagonal flow pumps that can maintain high performance in a wide range of operation condition from a small flow rate to a large flow rate.

The embodiments of the present invention are explained by using drawings.

Figure 2:
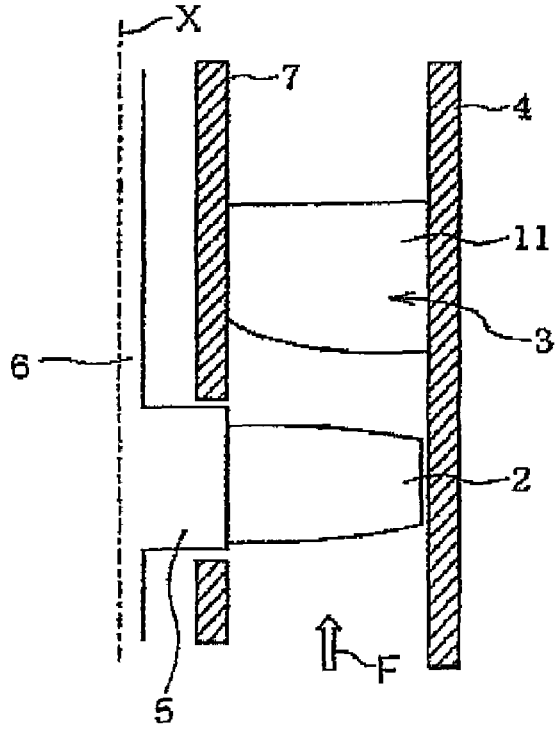
FIG. 2 is a schematic view that shows projection of a right half of an axial flow pump on a plane including the pump rotation axis.

As shown in FIG. 1, the axial flow pump has a plurality of impeller blades 2 and a plurality of guide vanes 3 which are placed downstream of the impeller blades 2, both of which are housed in a shroud 4. The impeller blades 2 are fixed to the rotation shaft 6 and the impeller blades 2 start to rotate with the rotational axis X of the rotation shaft 6 which is driven to rotate by a motor (not shown in the figures) coupled to the rotation shaft 6. The leading edges of the impeller blades 2 facing the shroud 4 are not fixed to the shroud 4. On the other hand, the guide vanes 3 do not rotate themselves but the leading edges of guide vanes 3 close to the pump rotation axis X are fixed to a guide vane hub 7 which surrounds the rotation shaft 5 and the other leading edges far from the pump rotation axis X are fixed to the shroud 4. The letter "F" in FIGS. 1 and 2 shows the flow velocity vector of the fluid.

Figure 3:
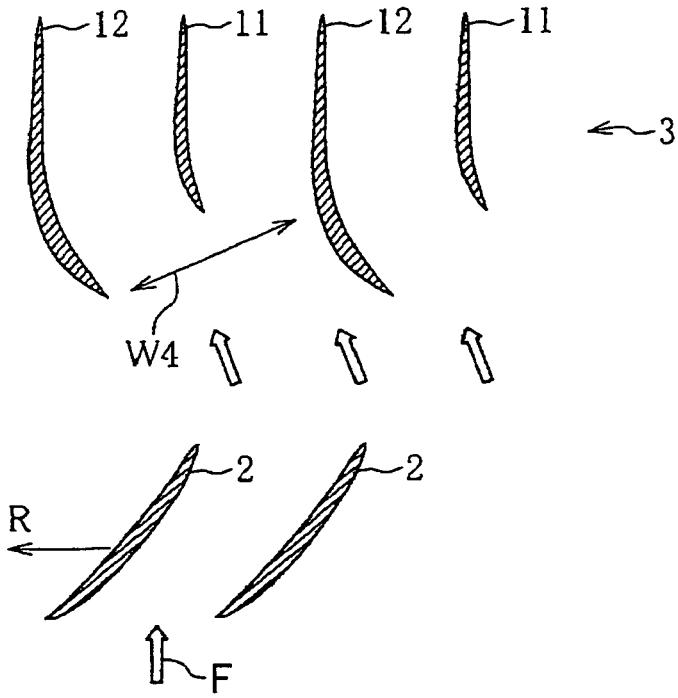
FIG. 3 is a schematic view that shows a cross-sectional view of impeller blades and guide vanes cut by a cylinder coaxial to the pump rotation axis in the region close to the hub.
Figure 4:
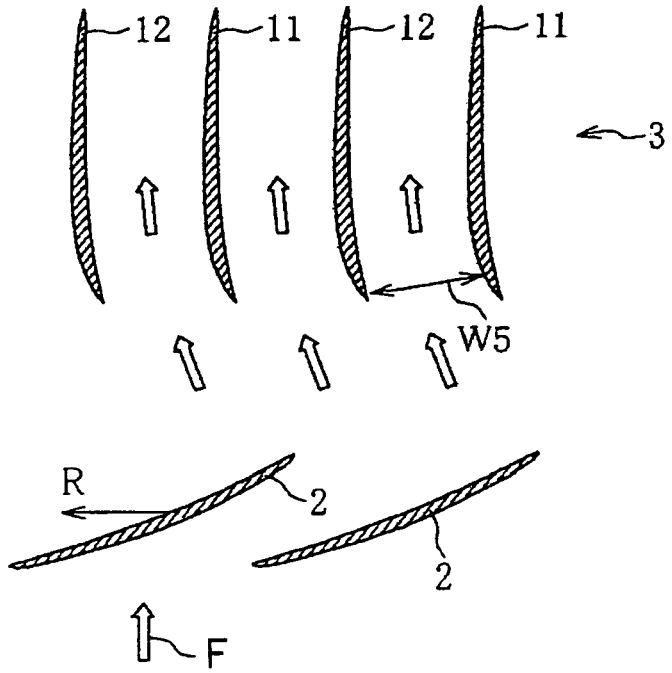
FIG. 4 is a schematic view that shows a cross-sectional view of impeller blades and guide vanes cut by a cylinder coaxial to the pump rotation axis in the region close to the shroud.

FIG. 3 and FIG. 4 show the cross sectional views of the impeller blades 2 and the guide vanes 3 cut by a cylinder which is coaxial to the pump rotation axis X. FIG. 3 shows the cross sectional views in the region close to the hub 7 and FIG. 4 shows the cross sectional views in the region close to the shroud 4.

As shown in FIG. 3 and FIG. 4, the guide vanes 3 comprise two kinds of guide vanes 11 and 12 which are alternately placed in the circumferential direction of a shroud. The guide vanes 12 have a longer length than the other guide vanes 11 in the region which is close to the surface of hub but have substantially the same length as the other guide vanes 11 in the region which is close to the shroud. The leading edges of the guide vanes 11 are located downstream in the pump axial direction. The letter "R" denotes the rotation direction.

Figure 5A:
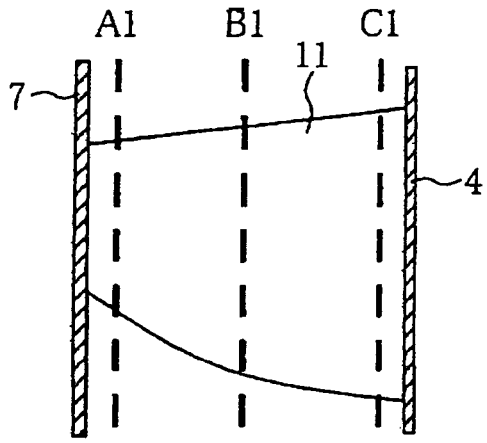
FIG. 5A is a schematic view that shows a projection view of a short guide vane in the circle direction.
Figure 5B:
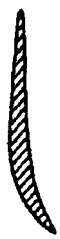
FIG. 5B is a schematic view that shows a cross-sectional view of a guide vane cut by three kinds of cylinders A1, C1 and B1 coaxial to the pump rotation axis: A1 has a radius close to the hub, C1 has a radius close to the shroud and B1 has a radius intermediate radius therebetween.
Figure 5B:
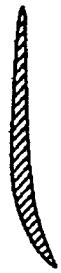
Figure 5B:
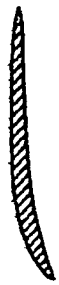
Figure 6A:
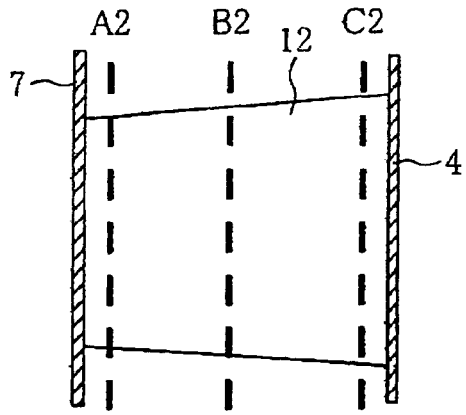
FIG. 6A is a schematic view that shows a projection view of a long guide vane in circle direction.
Figure 6B:
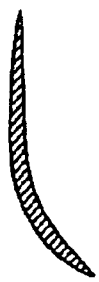
FIG. 6B is a schematic view that shows a cross-sectional view of a guide vane cut by three kinds of cylinders A2, C2 and B2 coaxial to the pump rotation axis: A2 has a radius close to the hub, C2 has a radius close to the shroud and B2 has an intermediate radius therebetween.
Figure 6B:
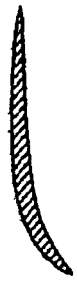
Figure 6B:
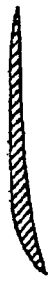

FIG. 5A and FIG. 6A show cross sectional views of the guide vanes 11 and the guide vanes 12 in the pump rotation direction, respectively. The cylinder surfaces A1, B1 and C1 are respectively defined as one close to the hub 7, one at an intermediate position between the hub 7 and the shroud 4, and one close to the shroud 4 in FIG. 5A. The same cylinder surfaces are denoted by A2, B2 and C2 in FIG. 6A. The cylinder surfaces A1 and A2, B1 and B2 and C1 and C2 are identically same. FIGS. 5B and 6B show the cross sectional views projected to these cylinders.

The guide vanes in accordance with the present invention satisfy the following two conditions.

(1) the length of the guide vanes 11 provides the relation;

(length of the guide vanes 11 cut by the cylinder A1)<

(length of the guide vanes 11 cut by the cylinder B1)<

(length of the guide vanes 11 cut by the cylinder C1)

(2) the length of the guide vanes 11 and the length of the guide vanes 12 provides the relation;

(length of the guide vanes 11 cut by the cylinder A1)<

(length of the guide vanes 12 cut by the cylinder A2)
and (length of the guide vanes 11 cut by the cylinder B1)<

(length of the guide vanes 12 cut by the cylinder B2)
and (length of the guide vanes 11 cut by the cylinder C1)≅

(length of the guide vanes 12 cut by the cylinder C2)

As for the guide vanes 11 which have a short vane length, the guide vanes keep the relation that the closer to the pump rotation axis a portion of a vane the shorter the length thereof with respect to the direction of the pump rotation axis. As for the guide vanes 12 which have long vane lengths, the relation between the lengths of the cross-sections of the guide vanes 12 on the cylinder A2, B2 and C2 can be arbitrarily determined.

The effect of the present invention is discussed as follows.

One of the important performances required for the axial flow pumps is efficiency in terms of how less of the flow kinetic energy is lost in the fluid flow.

Figure 7:
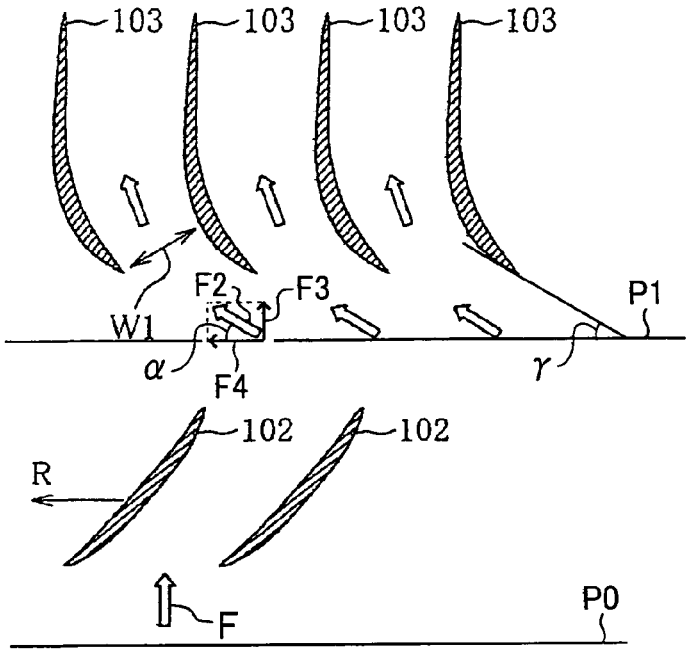
PRIOR ART FIG.7
FIG. 7 is a schematic cross-sectional view that shows cross sectional flows of the fluid in the region close to the hub under an optimum flow volume regarding conventional axial flow pumps.
Figure 8:
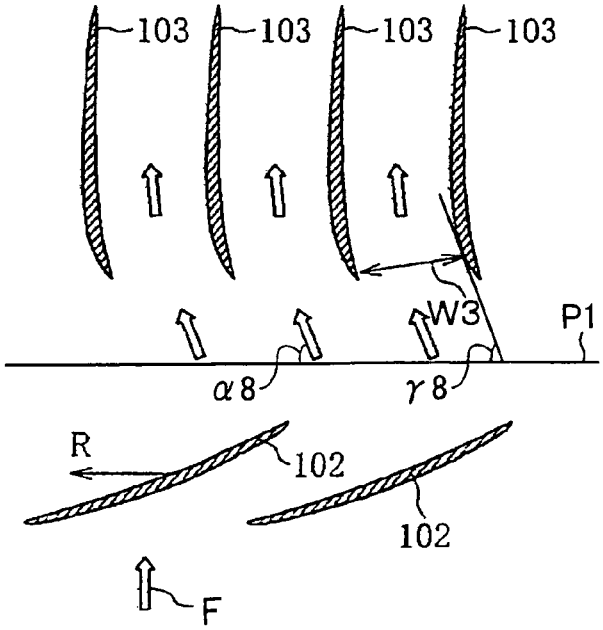
PRIOR ART FIG.8
FIG. 8 is a schematic cross-sectional view that shows flows of the fluid in the region close to the shroud under an optimum flow volume in accordance with conventional axial flow pumps.

In the operation condition that serves the maximum performance of the conventional guide vanes (wherein the maximum performance implies no generation of separation vortexes so that flow kinetic energy lost in the fluid dynamics is small), the regional flows of the fluid of the conventional axial pumps are depicted in the FIGS. 7 and 8 which show the cross sectional views cut in a cylindrical surface coaxial to the pump rotational axis. FIG. 7 shows the cross sectional flows in the region close to the hub and FIG. 8 shows the cross sectional flows in the region close to the shroud. The flows generated by the impeller blades 102 pass though and along the guide vanes 103 and the rotation component of the flow is effectively converted to the static pressure while the flows are passing through the guide vanes 103. Since the cross sectional flow distributions such as those close to the hub of the vanes and those close to the shroud are different due to the difference of the rotational flow rate at the outlet of the impeller blades, the cross sectional shape of the vane in the region close to the hub is designed to be more declined than that of the vane in the region close to the shroud. More specifically, the angle $\alpha$ shown in FIG. 7 is smaller than $\alpha$8 in FIG. 8. When the tip angles $\gamma$ and $\gamma$8 at the hub and the shroud which are aligned to the angles of the flow, respectively, are compared, then $\gamma$ becomes smaller than $\gamma$8.

FIG. 7 especially shows the flow rate condition that the no separation vortexes are generated at the tips of the guide vanes, which is defined as the "optimum flow condition". This condition can be depicted that the tangential line extended to the inlet cross sectional plane (P1) which is normal to the pump axial line has an angle $\gamma$ thereto. For this optimum flow condition, the flow has a relation such as $\alpha=\gamma$.

The angle $\alpha$ changes in accordance with the change in the flow rate. The flow rate is defined by the product of the cross sectional area of the flow and the projection of the flow velocity vector F. The component in the pump rotation plane is F3. For non-compressive flow, the flow volume across any cross sectional area is constant therefore the relation:

Flow rate measured at the impeller blade inlet

=Product of the inlet blade cross section area of the impeller blade and the projection of the flow velocity vector F at the impeller blade inlet P0

=Product of the outlet cross section area of the impeller blade and the projection of the flow velocity vector F2 at the impeller outlet P1

=Product of the outlet cross section area of F3

=Flow rate measured at impeller blade outlet

On the other hand, the component of F2 in the plane normal to the pump rotation axis is F4 and the rotation velocity in the flow rotating around the pump axis wherein the rotation velocity is added by the impeller rotation. According to this definition, the vector F and F3 changes in their magnitudes. When the flow rate increases by 10% then F3 increases by 10%. Generally the impeller blades rotate in a constant rotation speed. The rotation component of the flow rate added by the impeller rotation at the impeller blade outlet does not largely change at the optimum flow condition. Therefore, F4 does not largely change at the impeller blade outlet with the increase and decrease of the flow but F3 changes so that the angle $\alpha$ changes. This concludes that $\alpha$ becomes large and small when F3 becomes large and small, respectively.

Figure 9:
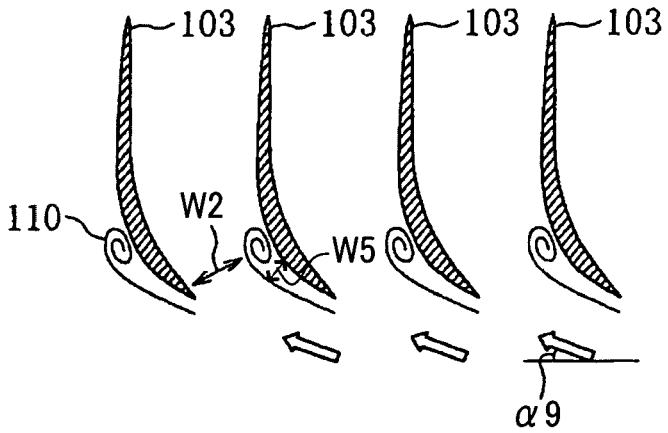
PRIOR ART FIG.9
FIG. 9 is a schematic cross-sectional view that shows flows under the condition that the flow in the region close to the hub is in a small flow rate in accordance with conventional axial flow pumps.

FIG. 9 shows the flows under the condition that the flow crossing the cross section area of the region close to the hub is in a small flow rate. When the flow rate becomes less, the flow rate to the direction of the flow path becomes small, the angle $\alpha$9 of the flow entering to guide vanes 103 becomes smaller than that in the optimum flow volume condition, that is $\alpha$ shown in FIG. 7. The flow direction at the leading edge of the guide vanes 103 and the direction of guide vanes 103 are deviated from each other. Therefore, the leading edges of the flow generates separation at the leading edges of the guide vanes 103 and the vortexes 110 caused by the separation are pushed away from the leading edges of the guide vanes 103 to downstream. These vortexes 110 "partially impede" the flow paths between two adjacent guide vanes 103 in the cross section and act as a resistance against the flow. In other words, the width of the flow path becomes narrow from W1 to W2. Therefore the overall pump performance is reduced.

The "impeding" of the flow is explained as follows. The vector F3 is smaller for the case shown in FIG. 7. The vortexes 110 are generated and their width is W5 in FIG. 9. In relation to FIG. 7, the following relation:

$$W1=W2+W5$$

can be obtained. Since the shape of the guide vanes is the same as that shown in FIG. 7, the interval between the adjacent vanes is constantly W1. FIG. 7 shows that the fluid flows from the inlet of the guide vanes to the outlet of the guide vanes. However the flow is turned into the separation vortexes 110 in the region close to the guide vanes and the fluid stays in the separation vortexes. The flow appears in such a manner that the fluid travels from the inlet of the guide vanes to the outlet through the channel shown as W2. The interval between the guide vanes is W1 and the separation vortex "impedes" the channel by a width of W5. Though the physical width of the channel is W1, the flow total rate is mainly determined by the channel excluding the vortex with W5 and the effective flow path is defined by the width W2.

Figure 10:
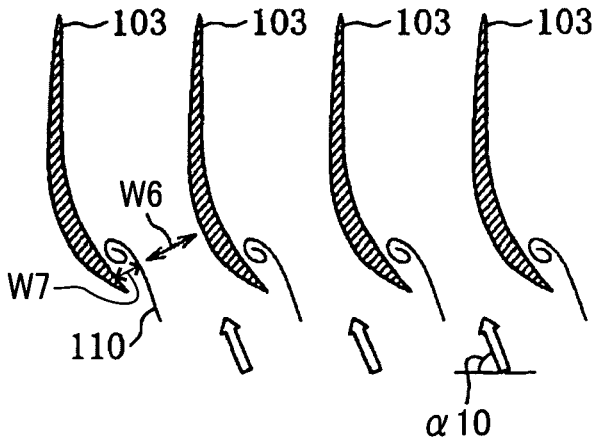
PRIOR ART FIG.10
FIG. 10 is a schematic cross-sectional view that shows flows under the condition that the flow in the region close to the hub is in a large flow rate in accordance with conventional axial flow pumps.

On the other hands, FIG. 10 shows the flow when the operation is done with a larger flow rate than the optimum condition. The component of the flow passing direction of the flow rate becomes large and the angle of the flow at the leading edges of the guide vanes 103 is deviated. The direction of the flow is deviated in direction opposite to the direction of the flow of case where the flow is in a small flow rate and therefore the separation is generated at the leading edges of the guide vanes 103 in the opposite side to the case shown in FIG. 9 so that the separation vortexes impede the flow paths and the effective flow path width is reduced to W6 as shown in FIG. 10. This results in the reduction of the pump performance. Since the radius in the region close to the hub is smaller than the radius in the region close to the shroud, the gap between two adjacent guide vanes is narrowed from W1 to W6 by the width W7 of the separation vortex (in other words, the area of the flow path at the inlet to the guide vanes), the influence of impeding the flow path by the separation vortexes is a particular problem.

The details of a flow with a large volume flow rate will be further explained. The width of the separation vortex is W7, then the width W6 of the channel of the flow becomes W6=W1−W7. The narrower the channel of the flow is, the larger the flow velocity is. Therefore the viscous resistance becomes large when the channel of the flow becomes narrow and flow energy is largely lost. Therefore, a wide flow path width is desired for the purpose of reducing the flow energy lost.

Figure 11:
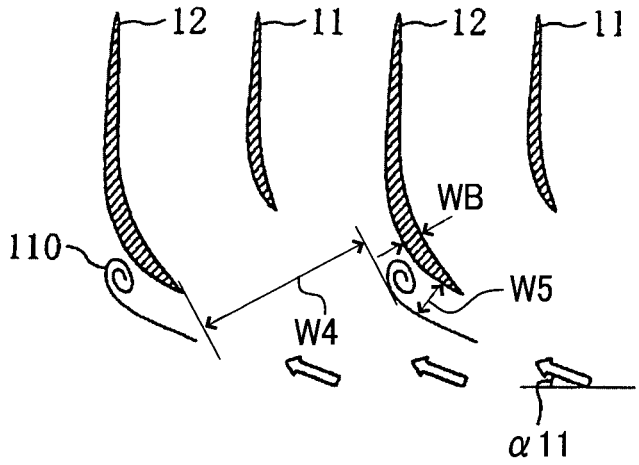
FIG. 11 is a schematic cross-sectional view that shows flows under the condition that the flow in the region close to the hub is in a small flow rate in accordance with axial flow pumps of the present invention.

FIG. 11 shows the flow of the present invention, particularly the flow in the cross section in the region close the hub when the operation is done with a small flow rate than the optimum condition. Due to the short length of the vanes 11 in the regions close to the hub, the flow path width at the leading edges of the guide vanes 12 is enlarged to be W4 (in other words, the area of the inlet to the flow path of the guide vanes is enlarged), and it can be understood that the effective area of the flow patch at the inlet to the guide vanes is obtained. By this configuration of vanes, the degree of narrowing the flow path W4 due to the generation of separation vortexes 110 caused by the angle α becoming small is decreased and the degrading of the performance is suppressed.

For this low flow rate, the detail is explained as follows. There are two separation vortexes over the three adjacent vanes. For the conventional configuration, the width of the effective flow path in the region of the three adjacent vanes is W2+W2 (=W1+W1−W5−W5). However for the present invention, only one separation vortex is generated and a width (WB) of one guide vane is removed in the channel of the flow and therefore the effective flow path is W4 (=W1+W1−W5−WB). The present invention can widen the width of the effective flow path with a smaller impeding dimension being W5+WB. Therefore the present invention provides less flow resistance and less flow energy lost.

Figure 12:
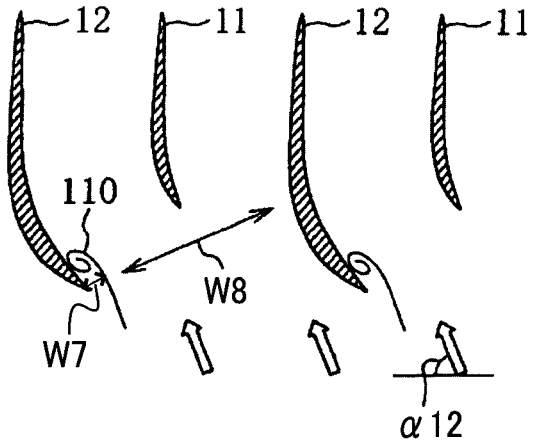
FIG. 12 is a schematic cross-sectional view that shows flows under the condition that the flow in the region close to the hub is in a large flow rate in accordance with axial flow pumps of the present invention.

FIG. 12 shows the flow under a condition such that the flow crossing the cross section area of the region close to the hub is in a large flow rate. The flow angle α12 shown in FIG. 12 which is for a large flow rate is larger than a shown in FIG. 7, the particular locations where the separation vortexes are generated are different in the cases shown in FIG. 12 and FIG. 11. The separation vortexes 110 are generated in the opposite side compared to the case where the flow volume is small but the reduction of the flow path width W4 is suppressed in the same reduction as in the case that the flow rate is small.

The details of the large flow rate will be further explained. The width of the effective flow path (in other words, a flow channel) can be widened with a small dimension being W7+WB since it is W8 (=W6+W6+W7+WB) in comparison to the conventional guide vane configuration. For the present invention, there is no separation vortexes generated for the optimum flow condition similar to the condition shown in FIG. 7 and the flow energy loss becomes small since the quantities of the separation vortexes is less generated for the flow conditions either over or under the optimum conditions.

The cross sections, of the guide vanes 3 located in the circumferential direction of the shroud, cut by a cylinder which is close to the shroud 4 are the same with respect to the length along the pump rotation axis. According to the facts that average flow path width W at the shroud is larger than that at the hub and the separation vortexes are less generated with the change in the flow rate, since the flow angle at the leading edges in the region close to the shroud is less keen than that at the leading edges in the region close to the hub. Accordingly, shortening the lengths of some of the vanes close to the shroud is not significantly advantageous. Actually, the variance of the flow angle is small for the case when the flow rate vary because the flow angle in the region close to the shroud is large and therefore separation vertexes are scarcely generated in the region close to the shroud, even when the separation vortexes are generated in the region close to the hub, so that the impeding of the flow paths due to the separation vortexes does not occur in the region close to the shroud in the most cases. Considering the original purpose of the guide vanes 3, which is to convert the rotational flow component to static pressure in high efficiency, it is concluded that the longer the length of the guide vanes in the region close to the shroud the better the performance.

As discussed before, since the present invention provides the effect that the area of the inlet to a flow path to guide vanes 11 and 12 is enlarged to W4 so that the effective area of the inlet to the flow path to the guide vanes 11 and 12 can be enlarged in the operation conditions other than that for the optimum flow volume, the degradation of the performance due to the separation vortexes generated in the leading edges of the guide vanes following the change in the flow rate can be suppressed into a minimum level and the high performance pump covering a wide range of operation condition from a small flow volume to a large flow volume can be realized.

Figure 13:
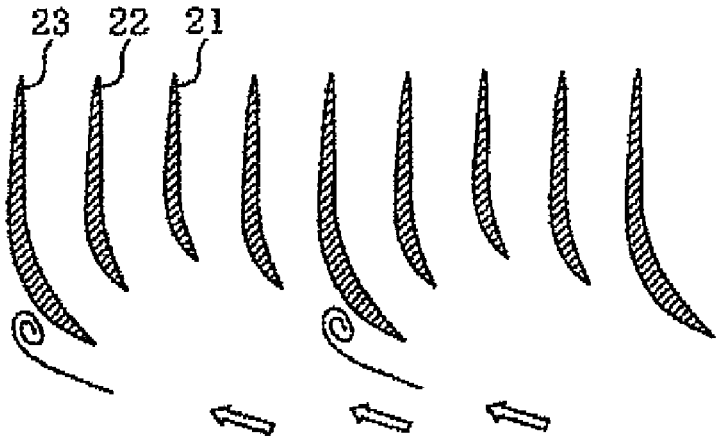
FIG. 13 is schematic view that shows an embodiment wherein three kinds of vanes are periodically set.

FIG. 13 shows an example that uses three kinds guide vanes 21, 22 and 23 which have different lengths and regularly is located in the circumferential direction of the shroud. In comparison to the case wherein two kinds of guide vanes are used, the average flow path width only at the inlet to the guide vanes can be effectively enlarged.

Figure 14:
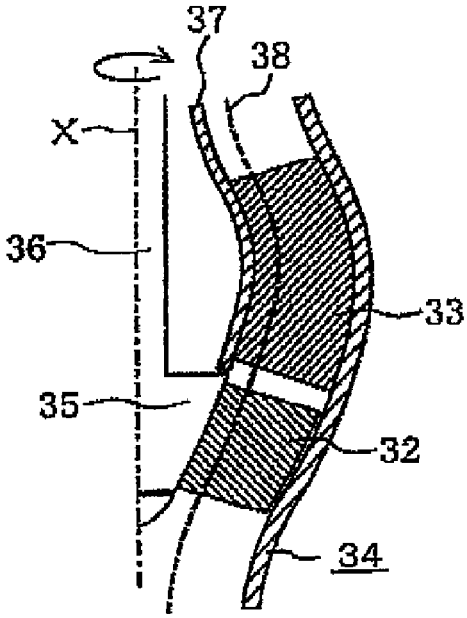
FIG. 14 is a schematic view that shows an embodiment of a diagonal flow pump to which the present invention is applied.

The guide vanes regarding the present invention can be adopted by other types of pumps. FIG. 14 shows an example applied to a diagonal flow pump. The diagonal flow pump has a plurality of impeller blades 32 and a plurality of guide vanes 33 which are placed downstream of the impeller blades 32, both of which are housed in the shroud 34. The impeller blades 32 are linked with the rotation shaft 36 and the impeller blades 33 start to rotate with the rotational axis X of the rotation shaft 36 which is driven to rotate by a motor (not shown in the figures) coupled to the rotation shaft 36. The edges of the impeller blades 32 facing to the shroud 34 are not fixed to the shroud 34. On the other hand, the guide vanes 33 do not rotate themselves, but the leading edges of guide vanes 33 close to the pump rotation axis X are fixed to a guide vane hub 37 which surrounds the rotation shaft 5 and the other leading edges far from the pump rotation axis X are fixed to the shroud 34.

For the diagonal flow pumps, the cross sectional shapes of the guide vanes 33 cut in the rotational surface 38 which is shown by a dotted line in FIG. 14 is preferably similar to the cross sectional shapes as shown in FIG. 3. In other words, a plurality of guide vanes 33 are set in the downstream of the plurality of impeller blades and the leading edges of the some guide vanes are placed downstream regarding to the pump rotation axis direction compared to the leading edges of the other guide vanes by the configuration that the plurality of the some guide vanes which have different kinds of guide vanes (for example, two kinds of guide vanes similar to the guide vanes 11 and 12) as different shapes or different lengths to the other vanes are regularly placed in the circumferential direction of the shroud.

By means of this embodiment of the present invention, the similar effect to the axial flow pumps regarding the high efficiency performance in wide range of flow rates around the optimum condition can be obtained for the diagonal flow pumps as well.

What is claimed is:

1. An axial flow pump comprising:

a plurality of impeller blades and a plurality of guide vanes which are fixed to a shroud and set downstream of said impeller blades, wherein said plurality of guide vanes has plural kinds of guide vanes of which one kind of said guide vanes has a different shape from the other kind/kinds of said guide vanes, said plurality of guide vanes being regularly located in a circumferential direction of said shroud such that leading edges of said one kind of guide vanes are set further downstream than leading edges of the other kind/kinds of said guide vanes so as to reduce generation of separation vortexes due to variation in a flow rate, said plurality of guide vanes includes two kinds of guide vanes being a first kind of guide vanes and a second kind of guide vanes such that said second kind of guide vanes are shorter than said first kind of guide vanes with respect to a said direction of a pump rotation axis and leading edges of said second kind of guide vanes are set further downstream than leading edges of said first kind of guide vanes, and said second kind of guide vanes have a shorter length in a region close to said pump rotation axis than a length in a region farther from said pump rotation axis, said lengths being with respect to said direction of said pump rotation axis, and said second kind of guide vanes have a shorter length than said first kind of guide vanes in a region close to said pump rotation axis, said length being with respect to said direction of said pump rotation axis.

2. An axial flow pump comprising a rotation shaft, a plurality of impeller blades provided on a surface of said rotation shaft, a plurality of guide vanes which are located downstream of said impeller blades, and a shroud fixing said guide vanes on an inner circumference of the shroud, wherein said plurality of guide vanes includes a plurality of first guide vanes and a plurality of second guide vanes;

said second guide vanes have a length, in a region close to said pump rotation shaft, shorter than a length in a region farther from said pump rotation shaft, said lengths being with respect to a direction of an axis of said pump rotation shaft, and shorter than a length of said first guide vanes, said length being with respect to said direction of said axis, leading edges of said second guide vanes are located downstream of leading edges of said first guide vanes, in said region close to said pump rotation shaft; and said first guide vanes and said second guide vanes are alternately located in a circumferential direction of said shroud.

3. An axial flow pump according to claim 2, wherein said plurality of guide vanes further includes a plurality of third guide vanes, said third guide vanes have a length shorter than a length of said first guide vanes, and longer than a length of said second guide vanes, said lengths being with respect to said direction of said axis; and said first, second and third guide vanes are alternately located in said circumferential direction of said shroud in a regular order.

4. A diagonal flow pump comprising a rotation shaft, a plurality of impeller blades provided on a surface of said rotation shaft, a plurality of guide vanes which are located downstream of said impeller blades, and a shroud fixing said guide vanes on an inner circumference of the shroud, wherein said plurality of guide vanes includes a plurality of first guide vanes and a plurality of second guide vanes;

said second guide vanes have a length, in a region close to said pump rotation shaft, shorter than a length in a region farther from said pump rotation shaft, said lengths being with respect to a direction of an axis of said pump rotation shaft, and shorter than a length of said first guide vanes, said length being with respect to said direction of said axis, leading edges of said second guide vanes are located downstream of leading edges of said first guide vanes, in said region close to said pump rotation shaft; and said first guide vanes and said second guide vanes are alternately located in a circumferential direction of said shroud.

5. A diagonal flow pump according to claim 4, wherein said plurality of guide vanes further includes a plurality of third guide vanes said third guide vanes have a length shorter than a length of said first guide vanes, and longer than a length of said second guide vanes, said length being with respect to said direction of said axis; and said first, second and third guide vanes are alternately located in said circumferential direction of said shroud in a regular order.

* * * * *

UNITED STATES PATENT AND TRADEMARK OFFICE

CERTIFICATE OF CORRECTION

PATENT NO. : 7,604,458 B2
APPLICATION NO. : 11/187082
DATED : October 20, 2009
INVENTOR(S) : Ishii et al.

It is certified that error appears in the above-identified patent and that said Letters Patent is hereby corrected as shown below:

Title page, item 73, should read: Hitachi, LTD., Tokyo (JP) Hitachi Plant Technologies, Ltd., Tokyo (JP).

Signed and Sealed this

Twenty-second Day of June, 2010

David J. Kappos

David J. Kappos
*Director of the United States Patent and Trademark Office*